United States Patent [19]

Helsper

[11] Patent Number: 4,947,962

[45] Date of Patent: Aug. 14, 1990

[54] ADJUSTABLE SCAFFOLD SUPPORT

[76] Inventor: Steve M. Helsper, 9712 McConnell Rd., Woodstock, Ill. 60098

[21] Appl. No.: 396,094

[22] Filed: Aug. 21, 1989

[51] Int. Cl.[5] ..... B27B 21/00; B25H 1/06

[52] U.S. Cl. ..... 182/182; 182/108; 182/184

[58] Field of Search ..... 182/181, 186, 224, 225, 182/108

[56] References Cited

U.S. PATENT DOCUMENTS

| | | | |
|---|---|---|---|
| 628,629 | 7/1899 | Mack . | |
| 695,310 | 3/1902 | Hersh | 182/182 |
| 841,418 | 1/1904 | Milner | 182/182 |
| 865,858 | 9/1907 | Bonenberger | 182/182 |
| 1,851,668 | 3/1932 | Goodwin | 182/181 |
| 2,127,035 | 8/1938 | Kirlin | 182/107 |
| 4,175,641 | 11/1979 | Reyes . | |
| 4,257,490 | 3/1981 | Bandy . | |
| 4,569,419 | 2/1986 | Stoltz . | |
| 4,669,574 | 6/1987 | Moutot . | |

FOREIGN PATENT DOCUMENTS

| | | | |
|---|---|---|---|
| 468821 | 10/1950 | Canada | 182/182 |
| 712377 | 7/1931 | France | 182/182 |
| 284742 | 11/1952 | Switzerland | 182/182 |

*Primary Examiner*—Reinaldo P. Machado
*Attorney, Agent, or Firm*—Jerry T. Kearns

[57] ABSTRACT

An adjustable scaffold support for use in supporting construction scaffold plank members includes a vertical guide member defining an elongated vertical guide track. An extension member is slidably received in the guide track and is secured in a selected adjusted position by a spring steel clamp and a set screw. A pivotal support member has a lower end pivotally connected to a lower end of the extension member. A pair of rectangular channel brackets are provided on upper end portions of the extension member and pivotal support member for engagement with a scaffold support plank. The scaffold support includes an A-frame supporting structure provided with selectively extensible ground insertion spikes for securing the scaffold support at an intended location.

14 Claims, 3 Drawing Sheets

ADJUSTABLE SCAFFOLD SUPPORT

BACKGROUND OF THE INVENTION

1. Field of the Invention

The present invention relates to adjustable supports, and more particularly pertains to an adjustable scaffold support for use in building construction. Scaffold supports are conventionally formed in an N-frame or a H-frame shaped construction. A plurality of planks are placed in a horizontal orientation between upper horizontal support members of the conventional scaffold supports. In order to increase the elevation of the scaffold, the conventional scaffold support construction requires that additional support members be stacked on top of the existing scaffold supports. This allows the horizontal work platform of the scaffold to be raised only in discreet increments. Additionally, the conventional scaffold supports heretofore utilized do not allow an adjustment of the inclination of the horizontal work platform surface. Finally, the conventional scaffold supports are of a rigid frame construction and require a relatively large amount of space for transportation and storage. In order to overcome these problems, the present invention provides an adjustable scaffold support which is collapsible for convenient storage and includes a pivotal support member to allow adjustment of the inclination of a scaffold work platform surface.

2. Description of the Prior Art

Various types of adjustable supports are known in the prior art. A typical example of such an adjustable support is to be found in U.S. Pat. No. 628,629, which issued to J. Mack on July 11, 1899. This patent discloses an extensible ladder including a pair of pivotally mounted side support members. U.S. Pat. No. 4,175,641, which issued to G. Reyes on Nov. 27, 1979, discloses a step ladder leg support adapted for pivotal mounting adjacent a top side portion of a ladder and including a ground engaging foot member. U.S. Pat. No. 4,257,490, which issued to I. Bandy on Mar. 24, 1981, discloses a portable observation stand adapted for attachment to a tree and including a plurality of extensible and pivotal support members. U.S. Pat. No. 4,569,419, which issued to G. Stoltz on Feb. 11, 1986, discloses a foldable step ladder including a plurality of pivotal cross members forming a X-shaped support brace. U.S. Pat. No. 4,669,574, which issued to P. Moutot on June 2, 1987, discloses a foldable staircase for attachment to an airplane which includes a plurality of pivotal support members.

While the above mentioned devices are directed to adjustable supports, none of these devices disclose an adjustable scaffold support which is collapsible for compact storage and transportation and allows the inclination of a scaffold work platform to be adjusted. Additional features of the present invention, not contemplated by the aforesaid prior art devices, include the provision of an extensible member mounted in a vertical guide and having a pivotal support member secured adjacent a lower end thereof, and including a pair of rectangular channel clamps for engagement with scaffold support members. Inasmuch as the art is relatively crowded with respect to these various types of adjustable supports, it can be appreciated that there is a continuing need for and interest in improvements to such adjustable supports, and in this respect, the present invention addresses this need and interest.

SUMMARY OF THE INVENTION

In view of the foregoing disadvantages inherent in the known types of adjustable supports now present in the prior art, the present invention provides an improved adjustable scaffold support. As such, the general purpose of the present invention, which will be described subsequently in greater detail, is to provide a new and improved adjustable scaffold support which has all the advantages of the prior art adjustable supports and none of the disadvantages.

To attain this, a representative embodiment of the concepts of the present invention is illustrated in the drawings and makes use of an adjustable scaffold support, for use in supporting construction scaffold plank members, which includes a vertical guide member defining an elongated vertical guide track. An extension member is slidably received in the guide track and is secured in a selected adjusted position by a spring steel clamp and a set screw. A pivotal support member has a lower end pivotally connected to a lower end of the extension member. A pair of rectangular channel brackets are provided on upper end portions of the extension member and pivotal support member for engagement with a scaffold support plank. The scaffold support includes an A-frame supporting structure provided with selectively extensible ground insertion spikes for securing the scaffold support at an intended location.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable scaffold support which has all the advantages of the prior art adjustable supports and none of the disadvantages.

It is another object of the present invention to provide a new and improved adjustable scaffold support which may be easily and efficiently manufactured and marketed.

It is a further object of the present invention to provide a new and improved adjustable scaffold support which is of a durable and reliable construction.

An even further object of the present invention is to provide a new and improved adjustable scaffold support which is susceptible of a low cost of manufacture with regard to both materials and labor, and which accordingly is then susceptible of low prices of sale to the consuming public, thereby making such adjustable supports economically available to the buying public.

Still yet another object of the present invention is to provide a new and improved adjustable scaffold support which provides in the apparatuses and methods of the prior art some of the advantages thereof, while simultaneously overcoming some of the disadvantages normally associated therewith.

Still another object of the present invention is to provide a new and improved adjustable scaffold support which is collapsible for convenient transportation and storage.

Yet another object of the present invention is to provide a new and improved adjustable scaffold support which allows the height of a scaffold work platform to be adjusted without requiring the use of additional support members.

Even still another object of the present invention is to provide a new and improved adjustable scaffold support which allows the inclination of a scaffold work platform to be adjusted.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
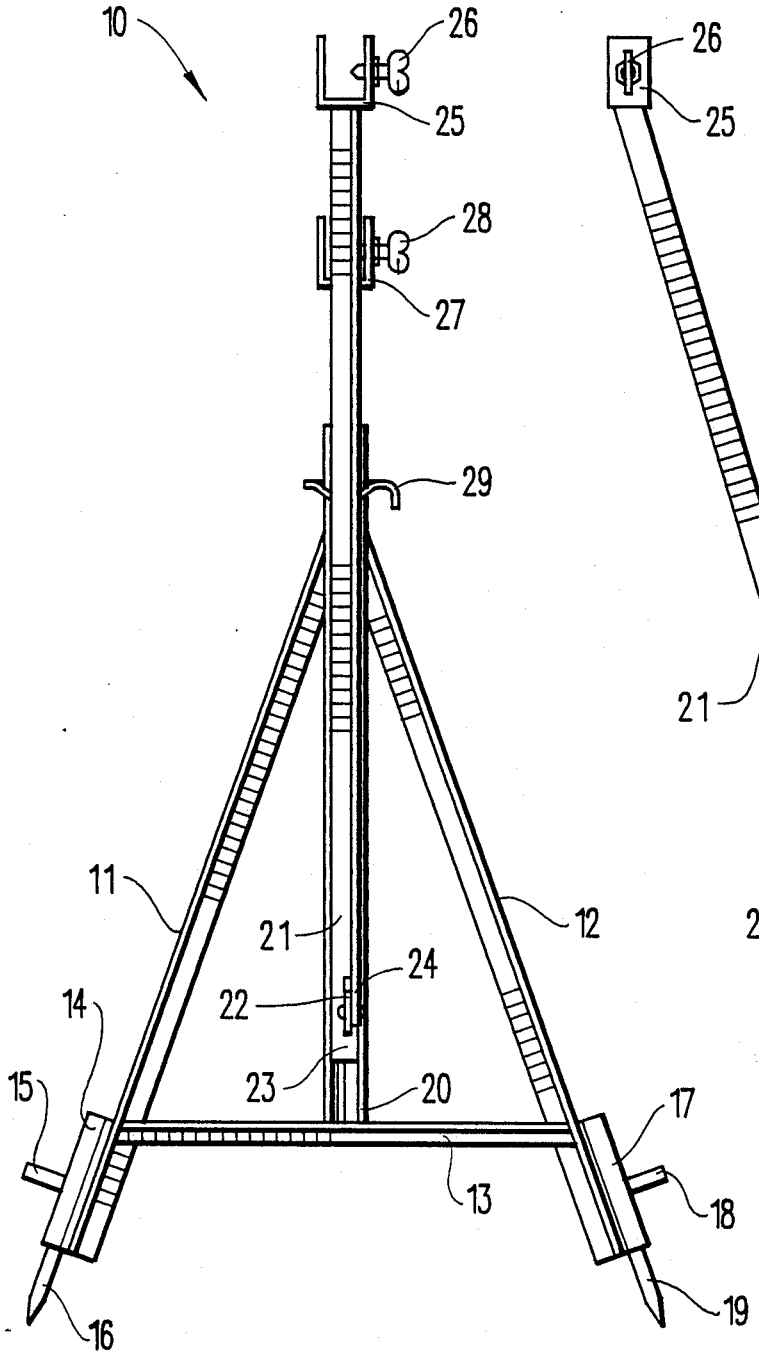
FIG. 1 is a front view illustrating the adjustable scaffold support according to the present invention.

With reference now to the drawings, and in particular to FIG. 1 thereof, a new and improved adjustable scaffold support embodying the principles and concepts of the present invention and generally designated by the reference numeral 10 will be described.

More specifically, it will be noted that the first embodiment 10 of the invention includes a generally cylindrical vertical guide member 20 which is formed from a hollow tube having a longitudinally extending open slotted portion. A cylindrical rod 23 is received for axial movement in telescopic relation within the guide member 20. The guide member 20 thus defines a guide track for the sliding rod 23. A first rectangular channel bracket 27 is secured on an upper end of the rod 23 for engagement with a scaffold support member, conventionally formed from a piece of lumber. A clamping screw 28 extends transversely through the bracket 27 to engage a scaffold plank and secure the plank within the bracket 27. A mounting tab 22 extends laterally from a lower portion of the rod 23, through the open slotted portion of the guide member 20. An elongated pivotal support member 21 has a lower end portion 24 pivotally secured to the mounting tab 22. A second rectangular channel bracket 25 is secured on an upper end of the pivotal support member 21 for engagement with a scaffold supporting plank. A clamping screw 26 extends transversely through the second bracket 25 to secure the scaffold supporting plank therein. A pair of side support rails 11 and 12 each have an upper end connected adjacent an upper end portion of the guide member 20. A lateral support brace 13 extends between lower end portions of the support rails 11 and 12. A bottom end of the guide member 20 is secured at a central portion of the lateral support brace, and the side support rails 11, 12 and the lateral support brace form an A-frame configuration. The side support rails 11, 12, the lateral support brace 13, and the pivotal support member 21, may all be inexpensively formed from a right angle iron stock material and secured in assembled relation by conventional threaded fasteners or by welding. A pair of cylindrical sockets 14 and 17 are secured on lower end portions of the side support rails 11 and 12 and slidably receive pointed cylindrical ground insertion spikes 16 and 19. Lateral projecting members 15 and 18 are secured to the spikes 16 and 19 and extend through elongated slots formed in the side walls of the sockets 14 and 17. A resilient spring clamp 29 is provided for securing the rod 23 in a selected adjusted position, in a manner to be subsequently illustrated and described in greater detail.

Figure 2:
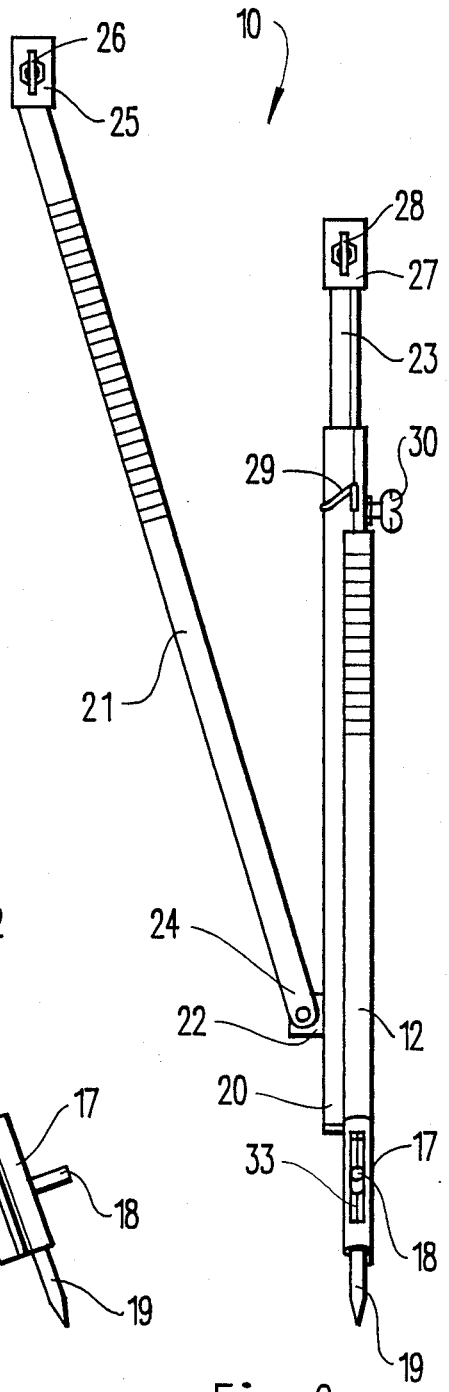
FIG. 2 is a side view of the scaffold support of FIG. 1.

FIG. 2 is a side view of the scaffold support of FIG. 1, which illustrates a set screw 30 extending transversely through the guide member 20 for securing the rod 23 in an adjusted position. The second scaffold plank engaging clamp 25 is secured at a slight angular orientation with respect to the pivotal support member 21 to provide proper alignment of the clamp 25 with a scaffold support plank. The projection member 18 secured to the spike 19 is received for reciprocal sliding movement within an elongated slot 33 formed in a side wall of the cylindrical socket 17. This construction allows the ground insertion spike members to be moved or driven into engagement with the ground to secure the scaffold support at an intended location.

Figure 3:
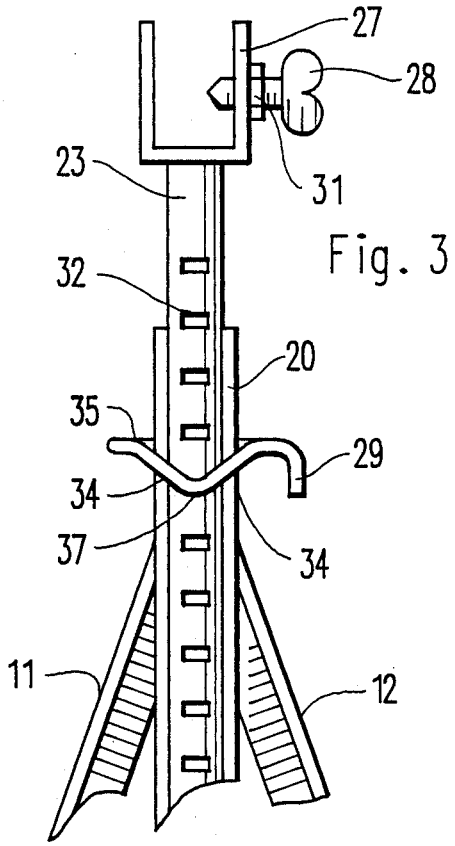
FIG. 3 is a detail view illustrating the extensible support member mounting mechanism of the scaffold support of the present invention.

FIG. 3 is a detail view which illustrates the retaining mechanism for securing the extension member or rod 23 in a selected adjusted position with respect to the guide member 20. A plurality of generally horizontal notches or grooves 32 are axially spaced along a side wall of the rod 23, in alignment with the open slotted portion of the guide member 20. A pair of obliquely inclined axially aligned grooves 34 are formed in the guide member 20, on opposite sides of the open slotted portion. A resilient spring steel clamp, preferably formed from a heavy gage steel wire, has one end 35 secured to the guide member 20 and an opposite end 29 which is free from securement and is provided with a hook portion for manual manipulation. The clamp 29 includes a V-shaped portion formed by two downwardly inclined portions intersecting at an apex 37 which is slightly flattened for engagement with a selected one of the notches 32. In use, an individual manually disengages the clamp 29 from the grooves 34 and the notches 32 which then allows manual extension or retraction of the rod 23. When the rod 23 has been adjusted to a desired position, the clamp 29 is then repositioned in the grooves 34 and the selected notch 32, to retain the rod 23 at the desired position.

Figure 4:
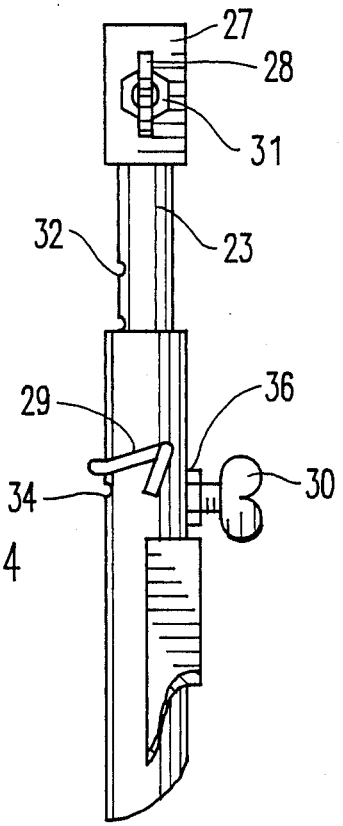
FIG. 4 is a side view further illustrating the extensible support adjustment mechanism.

As shown in FIG. 4, a set screw 30 extends through a transverse threaded aperture formed in the generally cylindrical guide member 20 for frictional engagement with a side wall portion of the rod 23. A lock nut 36 is provided for securing the set screw 30 in a locked condition. The set screw 30 provides a secure clamping force which, in conjunction with the resilient spring steel clamp 29, insures that the rod 23 will be not be retracted due to loading of a scaffold supported by engagement with the bracket 27.

Figure 5:
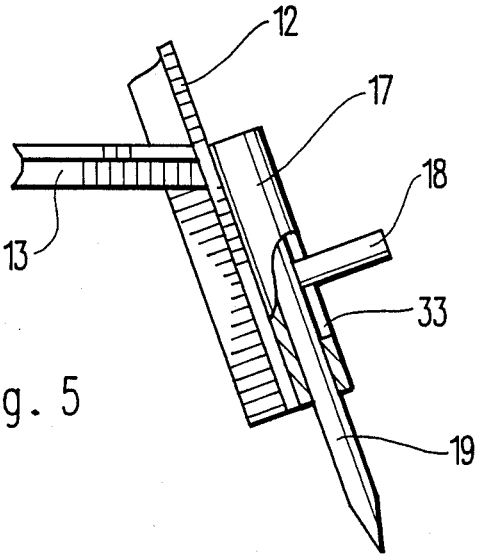
FIG. 5 is a detail view, partially in cross section, illustrating the construction of a ground insertion spike for securing the scaffold support in an intended location.

FIG. 5 is a detail view which further illustrates the construction of the ground insertion spike assembly utilized to secure the scaffold support in an intended position.

Figure 6:
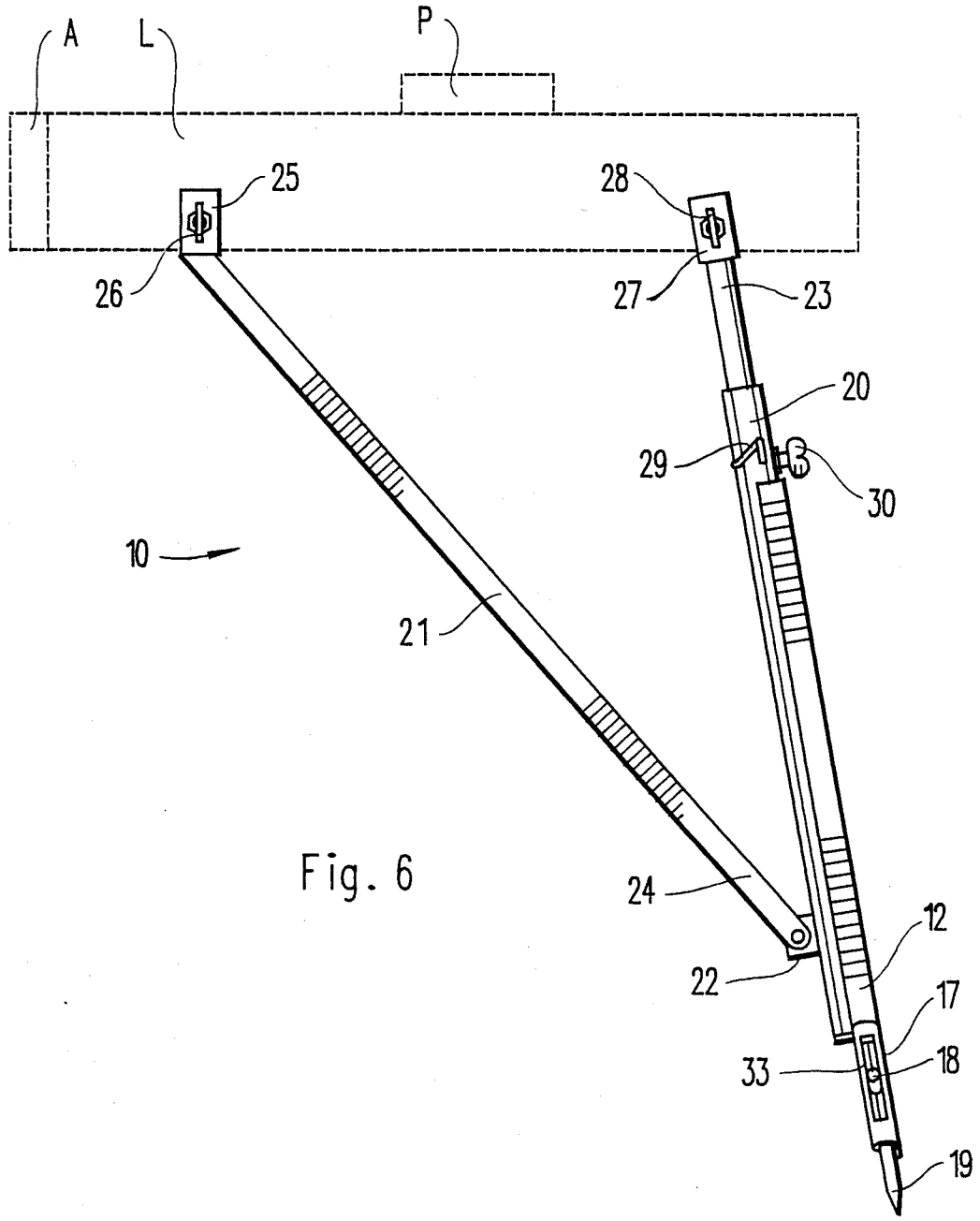
FIG. 6 is a side view illustrating the manner of use of the scaffold support member of the present invention.

FIG. 6 illustrates the adjustable scaffold support 10 disposed in an operative position. A piece of lumber L forms a side support for a scaffold plank P. A plurality of planks P will be disposed in a generally horizontal orientation, and be supported adjacent opposite ends by a pair of on edge support members L. The planks P may be secured to the support L by nailing, if desired. The support L will typically comprise an elongated piece of lumber L which is clamped in an on edge orientation within the channel brackets 25 and 27 through the use of the clamping screws 26 and 28. An opposite side of the scaffold will be supported by an additional adjustable scaffold support 10, in an identical fashion. Through the use of a pair of scaffold supports 10, a generally horizontal work support platform may be inexpensively and quickly erected for use in performing construction operations on a building. An inner end portion A of the support member L may be provided with a soft padding for abutment with an exterior building wall surface. Because of the extensible adjustable mounting of the rod 23 and the pivotal mounting of the support member 21, the elevation and the inclination of the scaffold support member L may be adjusted as required to provide a work platform at any desired elevation and inclination. When a job is completed, the scaffold supports 10 may be quickly collapsed to a compact size for storage and transportation. The engagement of the ground insertion spikes insures a safe and stable scaffold work platform.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable scaffold support, comprising:

a generally cylindrical hollow guide member having an elongated open slotted portion;

a cylindrical rod received for axial movement in telescopic relation within said guide member;

a first rectangular channel bracket on an upper end of said cylindrical rod for engagement with a scaffold member;

a clamping screw extending transversely through said first bracket to secure a scaffold member within said first bracket;

a plurality of generally horizontal notches axially spaced along said cylindrical rod;

a pair of obliquely inclined axially aligned grooves formed in said guide member, on opposite sides of said open slotted portions;

a resilient spring steel clamp having one end secured to said guide member, said spring steel clamp having a V-shaped portion formed by two downwardly inclined portions intersecting at an apex, said downwardly inclined clamp portions dimensioned for engagement with said axially aligned grooves on said guide member and said apex of said clamp dimensioned for engagement with a selected one of said horizontal notches on said rod for securing said rod in an axially adjusted position within said guide member;

a set screw extending transversely through said guide member for securing said rod in an adjusted position;

a pair of side support rails each having an upper end connected adjacent an upper end of said guide member;

a lateral support brace extending between lower portions of said support rails, a bottom end of said guide members secured at a central portion of said lateral support brace, said side support rails and said lateral support brace forming an A-frame configuration;

a pair of cylindrical sockets secured on lower end portions of said side support rails;

an elongated slot formed through a side wall of each of said sockets;

a pointed tip cylindrical ground insertion spike slidably received in each of said sockets;

a lateral projection secured to each of said spikes and extending through a slot of one of said sockets;

a mounting tab extending laterally from a lower portion of said rod through said open slotted portion of said guide member;

an elongated pivotal support member having a lower end pivotally secured to said mounting tab;

a second rectangular channel bracket on an upper end of said pivotal support member for engagement with a scaffold member;

and a clamping screw extending transversely through said second bracket to secure a scaffold member within said second bracket.

2. An adjustable scaffold support, comprising:

a vertical guide member defining an elongated vertical guide track;

an extension member slidably received in said guide track;

a plurality of generally horizontal grooves axially spaced along said extension member;

a pair of axially aligned grooves in said guide member;

a resilient spring steel clamp on said guide member disposed for frictional engagement with said axially aligned grooves and a selected one of said horizontal grooves for securing said extension member in a selected adjusted position with respect to said guide member;

first clamping means on an upper end of said extension member for engagement with a scaffold member;

and frame means connected to said guide member for securing said guide member in a vertical orientation.

3. The adjustable scaffold support of claim 2, wherein said axially aligned grooves are obliquely inclined.

4. The adjustable scaffold support of claim 3, wherein said spring steel clamp has one end secured to said guide member and has a V-shaped portion formed by two downwardly inclined portions intersecting at an apex, said downwardly inclined clamp portions dimensioned for engagement with axially aligned grooves on said guide member and said apex of said clamp dimensioned for engagement with a selected one of said horizontal grooves on said extension member.

5. The adjustable scaffold support of claim 2, further comprising a pivotal support member having a lower end pivotally connected to said extension member;

and second clamping means on an upper end of said pivotal support member for engagement with a scaffold member.

6. The adjustable scaffold support of claim 2, wherein said frame means comprises an A-shaped frame configuration.

7. The adjustable scaffold support of claim 2, wherein said frame means comprises:

a pair of side support rails each having an upper end connected adjacent an upper end of said guide member;

and a lateral support brace extending between lower portions of said support rails, a bottom end of said guide members secured at a central portion of said lateral support brace, said side support rails and said lateral support brace forming an A-frame configuration.

8. The adjustable scaffold support of claim 7, further comprising:

a pair of cylindrical sockets secured on lower end portions of said side support rails;

and a ground insertion spike mounted for extension and retraction in each of said sockets.

9. The adjustable scaffold support of claim 8, further comprising an elongated slot formed through a side wall of each of said sockets and a lateral projection secured to each of said spikes and extending transversely through said slots.

10. The adjustable scaffold support of claim 2, further comprising at least one ground insertion spike mounted for selective extension and retraction on said frame means.

11. The adjustable scaffold support of claim 2, further comprising:

a pair of cylindrical sockets secured on a lower end portion of said frame means;

a ground insertion spike mounted for extension and retraction in each of said sockets;

an elongated slot formed through a side wall of each of said sockets;

and a lateral projection secured to each of said spikes and transversely extending through said slots.

12. The adjustable scaffold support of claim 2, wherein said vertical guide member comprises a generally cylindrical tube having an elongated open slotted portion;

and said extension member comprises an elongated cylindrical rod slidably received in said tube.

13. The adjustable scaffold support of claim 12, further comprising:

a mounting tab extending laterally from a lower end portion of said rod through said open slotted portion of said guide member;

a pivotal support member having a lower end pivotally secured to said mounting tab;

and second clamping means on an upper end of said pivotal support member for engagement with a scaffold member.

14. The adjustable scaffold support of claim 12, further comprising a set screw extending transversely through said guide member for securing said extension member in an adjusted position.

* * * * *